US006609572B1

(12) United States Patent
Andersen et al.

(10) Patent No.: US 6,609,572 B1
(45) Date of Patent: Aug. 26, 2003

(54) RISER CONNECTOR

(75) Inventors: Jan Oddvar Andersen, Randaberg (NO); Vidar Larsen, Kleppe (NO)

(73) Assignee: Smedvig Offshore AS, Stavanger (NO)

( * ) Notice: Subject to any disclaimer, the term of this patent is extended or adjusted under 35 U.S.C. 154(b) by 0 days.

(21) Appl. No.: 10/060,343

(22) Filed: Feb. 1, 2002

(51) Int. Cl.[7] ..... E21B 29/12

(52) U.S. Cl. ..... 166/345; 166/338; 166/350; 166/360; 285/18; 285/922

(58) Field of Search ..... 166/338, 341, 166/344, 345, 348, 350, 368, 360, 242.6; 285/18, 27, 922

(56) References Cited

U.S. PATENT DOCUMENTS

| | | | | | |
|---|---|---|---|---|---|
| 2,962,096 | A | * | 11/1960 | Knox | 285/27 |
| 3,321,217 | A | * | 5/1967 | Ahlstone | 285/18 |
| 3,675,713 | A | * | 7/1972 | Watkins | 166/340 |
| 3,851,897 | A | * | 12/1974 | Piazza et al. | 285/18 |
| 4,046,192 | A | * | 9/1977 | Darnborough et al. | 166/337 |
| 4,057,267 | A | * | 11/1977 | Jansen, Jr. | 285/18 |
| 4,153,278 | A | * | 5/1979 | Ahlstone | 285/18 |
| 4,441,742 | A | * | 4/1984 | Owens, III | 285/18 |
| 4,491,345 | A | * | 1/1985 | Regan | 285/18 |
| 4,647,254 | A | | 3/1987 | Baugh et al. | |
| 4,699,215 | A | * | 10/1987 | Cuiper | 166/341 |
| 4,708,376 | A | * | 11/1987 | Jennings et al. | 285/315 |
| 4,721,132 | A | | 1/1988 | Houlgrave | |
| 4,819,967 | A | * | 4/1989 | Calder et al. | 285/18 |
| 4,856,594 | A | | 8/1989 | Jennings | |
| 5,382,056 | A | | 1/1995 | Milberger | |
| 5,846,028 | A | * | 12/1998 | Thory | 405/195.1 |
| 6,234,252 | B1 | | 5/2001 | Pallini, Jr. et al. | |

* cited by examiner

*Primary Examiner*—Thomas B. Will
*Assistant Examiner*—Thomas A. Beach
(74) *Attorney, Agent, or Firm*—Birch, Stewart, Kolasch & Birch, LLP

(57) ABSTRACT

A system for connecting and disconnecting a lower end of a marine riser (25) to and from a blow out preventer stack on a subsea Wellhead comprises gripping members (26) for the marine riser and a lock element (27) for locking the gripping members (26). The system comprises first primary actuators (28), second primary actuators (29) and secondary actuators (30) for moving the lock element (27) to an unlock position, and hydraulic circuitry for actuating the actuators. The system further comprises a hydraulic backup unlock circuit (9, 11, 16) comprising a triple flow divider (8) for dividing fluid flow from a source (16) into one flow for actuating the first primary actuators (28), one flow for actuating the second primary actuators (29) and one flow for actuating the secondary actuators (30).

10 Claims, 3 Drawing Sheets

RISER CONNECTOR

BACKGROUND OF THE INVENTION

The invention relates to a system for Connecting and disconnecting a lower end of a marine riser to and from a blow out preventer stack on a subsea wellhead according to the preamble of claim 1.

Drilling of offshore hydrocarbon wells is performed by a drill string arranged in a riser extending from a blow out preventer stack on a wellhead on the sea floor to a drilling vessel. The drilling vessel may be anchored to the sea floor or kept in position by thrusters of a dynamic positioning system. The lower end of the riser is connected to the blow out preventer stack by a riser connector, which includes some type of hydraulically operated gripping members, such as fingers which in a clamping position clamp a flange of the lower end of the riser. The riser connector also includes a lock element, which by means of hydraulic actuators can be moved between a lock position in which the lock element locks the gripping members in the clamping position, and an unlock position in which the gripping members are free to move to a release position, i.e. a position which allows connecting and disconnecting the riser end.

Connectors which may be used for connecting a riser to a wellhead are disclosed in U.S. Pat. No. 4,721,132, U.S. Pat. No. 5,382,056 and U.S. Pat. No. 6,234,252.

In order to allow a transversal movement of the drilling vessel, which may be caused by wind, waves and current, the riser is normally connected to the riser connector via a flexible joint which allows some angular displacement of the riser. To allow a vertical movement of the drilling vessel, the riser is also equipped with a telescopic joint. If the angular displacement of the riser exceeds a maximum acceptable angle, dictated by mechanical limitations of the flexible joint or the telescopic joint, the riser will be disconnected from the blow out preventer stack on the wellhead.

When disconnecting the riser the hydraulic actuators are pressurised to move the lock element to the unlock position. The gripping members are then free to move to the release position, and the riser can be withdrawn and disconnected. For various reasons, e.g. a jamming of the lock element, moving the lock element to the unlock position may require greater forces than moving the lock element to the lock position. For this reason the hydraulic actuators may consist of primary hydraulic actuators able to move the lock element between the lock position and the unlock position, and secondary hydraulic actuators merely able to move the lock element to the unlock position. Thereby greater forces are available for moving the lock element to the unlock position then for moving the lock element to the lock position.

SUMMARY OF THE INVENTION

Hydraulic circuitry which pressurise the hydraulic actuators may for various reasons fail. Reasons for failure include malfunctioning of valves, clogging or rupture of hydraulic lines or jamming of the hydraulic actuators. In order to increase the reliability of the hydraulic circuitry the circuitry may comprise a hydraulic primary unlock circuit for actuating the primary actuators and a hydraulic secondary unlock circuit for actuating the secondary actuators. This a proven design which is in use with many riser connectors. There is, however, a wish to further increase the reliability of the hydraulic circuitry, but in order to gain acceptance in the market, a system with increased reliability should also include the proven design comprising the primary aid secondary unlock circuits.

The objective of the invention is therefore to provide a system for connecting and disconnecting a lower end of a marine riser to and from a blow out preventer stack on a subsea wellhead, which system shall comprise a highly reliable backup system for disconnecting the riser. A further objective is that the system shall combine the proven design comprising the primary and secondary hydraulic unlock circuits with the backup system.

The objectives are achieved by a system according to the claims.

The invention then provides a system for connecting and disconnecting a lower end of a marine riser to and from a blow out preventer stack on a subsea wellhead, comprising:

- a riser connector comprising:
  - gripping members movable between a clamping position in which they clamp the riser end and a release position in which the riser end is released,
  - a lock element movable between a lock position in which the lock element lock the gripping members in the clamping position and an unlock position in which the gripping members are free to move to their release position,
  - primary hydraulic actuators able to move the lock element between the lock position and the unlock position,
  - secondary hydraulic actuators merely able to move the lock element to the unlock position, and
- hydraulic circuitry comprising:
  - a hydraulic lock circuit for actuating the primary actuators to move the lock element to the lock position and move the secondary actuators to a position from which they can move the lock element to the unlock position,
  - a hydraulic primary unlock circuit for actuating the primary actuators to move the lock element to the unlock position,
  - a hydraulic secondary unlock circuit for actuating the secondary actuators to move the lock element to the unlock position.

According to the invention,

- the primary unlock circuit comprises a first primary unlock circuit for actuating first primary actuators and a second primary unlock circuit for actuating second primary actuators, and the system further comprises:
  - a hydraulic backup unlock circuit for actuating the primary and secondary actuators to move the lock element to the unlock position, the backup unlock circuit comprises a source for pressurised hydraulic fluid and a triple flow divider for dividing fluid flow from the source into one flow for actuating the first primary actuators, one flow for actuating the second primary actuators and one flow for actuating the secondary actuators.

The invention thereby provides a hydraulic backup unlock circuit with three independent flows for actuating the actuators which move the lock element to the unlock position. A rupture in a conduit for one of these independent flows will result in that the actuators which are supplied from this conduit will fail in moving the lock element to the unlock position, while the remaining actuators will maintain their ability to move the lock element to the unlock position. It is thereby provided a highly reliable backup system for disconnecting the riser.

Further, by dividing the primary unlock circuit into the first primary unlock circuit and the second primary unlock circuit, the two unlock circuits according to proven design, namely the primary and secondary unlock circuits, are combined with the backup system.

BRIEF DESCRIPTION OF THE DRAWINGS

The invention will now be explained in closer detail with reference to the enclosed drawings, in which.

DETAILED DESCRIPTION OF THE INVENTION

Figure 1:
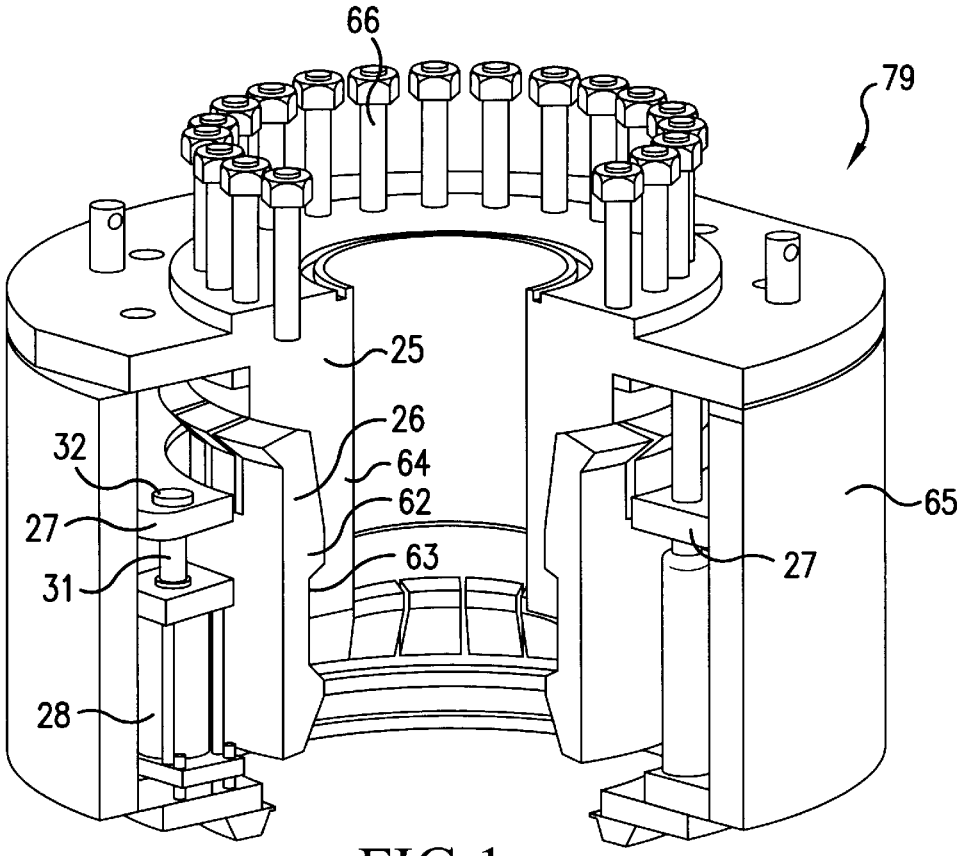
FIG.1 PRIOR ART
FIG. 1 is a side view, partly cut away, of a riser connector according to prior art.

FIG. 1 is a side view, partly cut away, of a riser connector 19 which forms an upper part of a not illustrated blow out preventer stack (BOP stack) which is located on a not illustrated wellhead on a sea floor. The blow out preventer stack and the wellhead forms an upper part of a not illustrated hydrocarbon well, The riser connector 19 includes gripping members 26 which are illustrated in a clamping position in which they clamp an insert 64 which forms part of a hub 25. The hub 25 is connected to a not illustrated marine riser by bolts 66, i.e. the hub 25 forms a lower end of the riser.

The marine riser extends to a not illustrated drilling vessel, and drilling of the hydrocarbon well is carried out by a drill string extending from the drilling vessel through the riser, through the riser connector 19, through the blow out preventer stack and the wellhead.

The illustrated riser connector is a widely used riser connector manufactured by "Cameron". The gripping members 26 have the shape of gripping fingers. The gripping fingers 26 have projections 62, which in the illustrated clamping position mate with and clamp corresponding projections 63 of the insert 64. In the clamping position the gripping fingers 26 are radially locked by a lock element 27, formed by a cam ring, which is then said to be in its lock position.

The cam ring 27 is movable in the longitudinal direction of the gripping fingers 26, between the illustrated lock position and a not illustrated unlock position in which portions of the gripping fingers having the projections 62 are free to move somewhat radially outwards from the illustrated clamping position, to a release position. When the gripping fingers 26 are in their release position, the insert 64 with its projections 63 can be inserted into or withdrawn from the riser connector. Thus, when the cam ring 27 is in its unlock position, the lower end of the riser, i.e. the hub 25, can be connected to or disconnected from the blow out preventer stack.

The movement of the cam ring 27 between the lock position and the unlock position is done by hydraulic actuators 28, located in a housing 65, and hydraulic circuitry for pressurising the actuators. When the cam ring 27 is in its lock position, it is kept in place by friction forces between the cam ring 27 and the gripping fingers 26.

Figure 2:
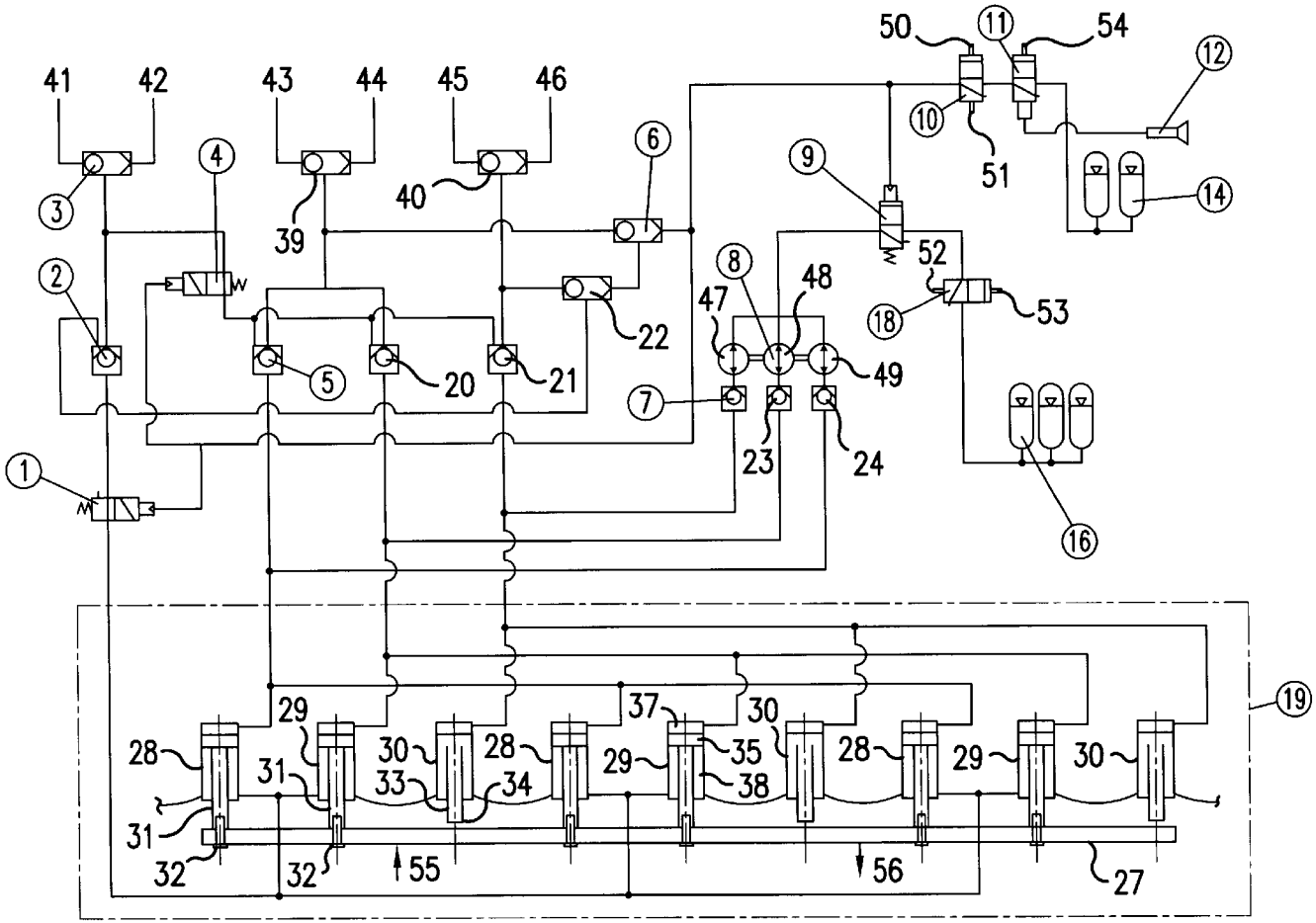
FIG. 2 is a diagram illustrating the system according to the invention with a backup unlock circuit in a disabled state.

Fig. 2 illustrates the system according to the invention, comprising a riser connector 19 and hydraulic circuitry for operating hydraulic actuators 28, 29, 30 of the riser connector 19. The lock element 27 is schematically illustrated as a bar. Arrow 55 indicates the direction of movement of the lock element 27 to the lock position, while arrow 56 indicates the direction of movement of the lock element to the unlock position. The invention is not dependent upon any particular design of the riser connector 19, The riser connector discussed with reference to FIG. 1 is therefore to be regarded as a typical riser connector which can be used with the invention.

For various reasons, e.g. deposition of particles or mechanical deformations, the lock element 27 may be jammed in the lock position, which means that great forces are required to move the lock element to the unlock position.

According to known design, like in the illustrated riser connector in FIG. 1, the hydraulic actuators comprise primary actuators 28, 29 which are able to move the lock element 27 between the lock position and the unlock position, and secondary actuators 30 merely able to move the lock element 27 to the unlock position. With reference to FIG. 2, this has been achieved by piston rods 31 of the primary actuators 28, 29 being mechanically connected to the lock element 27, while piston rods 33 of the secondary actuators 30 are merely abutting the lock element 27. Thus more actuators, and consequently more forces, can be used to move the lock element to the unlock position than to move the lock element to the lock position. This increases the riser connector's ability to move a jammed lock element from the lock position to the unlock position.

In the following discussion of hydraulic circuitry hydraulic fluid is said to flow in the circuits. This is for simplifying the description, since, like in all hydraulic circuits, the effects are achieved partly by a distribution of pressure and partly by a movement of the fluid.

The hydraulic circuitry illustrated in FIG. 2 comprises a hydraulic lock circuit for moving the lock element 27 to the lock position. The lock circuit comprises lock circuit inlet/outlet valve 3 with inlet 41 and outlet 42. Lock circuit inlet/outlet valve 3 is connected to pilot operated vent valve 4 and pilot operated check valve 2, which prevents return flow of hydraulic fluid from the hydraulic actuators 28, 29, 30 to outlet 42 of the lock circuit, Pilot operated check valve 2 is connected to backup vent valve 1, which is connected to the piston rod side of the hydraulic actuators 28, 29, 30.

When it is desired to move the lock element 27 to the lock position, pressurised hydraulic fluid is supplied to inlet 41 of lock circuit inlet/outlet valve 3. The supply of pressurised hydraulic fluid to inlet 41 closes outlet 42. Pilot operated vent valve 4 is open, and hydraulic fluid therefore flows from lock circuit inlet/outlet valve 3, through pilot operated vent valve 4 and to control ports of pilot operated check valves 5, 20, 21, which opens the check valves 5, 20, 21 and allows hydraulic fluid to flow from the piston side of the hydraulic actuators 28, 29, 30. Hydraulic fluid also flows from lock circuit inlet/outlet valve 3 through pilot operated check valve 2, through backup vent valve 1 which is open, and to the piston rod side of the hydraulic actuators 28, 29, 30. Lock element 27 is thereby moved in direction 55, to the lock position.

The hydraulic circuitry also comprises a primary unlock circuit for actuating the primary actuators 28, 29 to move the lock element 27 to the unlock position. The primary unlock circuit comprises primary unlock inlet/outlet valve 39 with inlet 43 and outlet 44. Primary unlock inlet/outlet valve 39 is connected to primary unlock shuttle valve 6, which is connected to secondary unlock shuttle valve 22, which is connected to a control port of pilot operated check valve 2.

Primary unlock inlet/outlet valve 39 is further connected to pilot operated first primary unlock check valve 5 and second primary unlock check valve 20. In this way the primary unlock circuit is divided in a first primary unlock circuit and a second primary unlock circuit. First primary unlock check valve 5 is connected to the piston side of first primary actuators 28, while second primary unlock check valve 20 is connected to the piston side of second primary actuators 29.

Still with reference to FIG. 2, when it is desired to move the lock element 27 to the unlock position, pressurised hydraulic fluid is supplied to inlet 43 of primary unlock inlet/outlet valve 39. This closes outlet 44. Hydraulic fluid flows from primary unlock inlet/outlet valve 39 to primary unlock shuttle valve 6, further to secondary unlock shuttle valve 22 and to pilot operated check valve 2. Pilot operated check valve 2 is thereby opened, which allows hydraulic fluid to flow from the piston rod side of the hydraulic actuators, out through outlet 42 of the lock circuit. Further the flow of hydraulic fluid from primary unlock inlet/outlet valve 39 is split into two flows, one flow through first primary unlock check valve 5 and further to the piston side of first primary actuators 28, and one flow through second primary unlock check valve 20 and further to the piston side of second primary actuators 29. Lock element 27 is thereby moved in direction 56, to the unlock position.

The hydraulic circuitry also comprises a secondary unlock circuit for actuating the secondary actuators 30 to move the lock element 27 to the unlock position. The secondary unlock circuit comprises secondary unlock inlet/outlet valve 40 with inlet 45 and outlet 46. Secondary unlock inlet/outlet valve 40 is connected to secondary unlock shuttle valve 22, which is connected to the control port of pilot operated check valve 2. Secondary unlock inlet/outlet valve 40 is further connected to pilot operated secondary unlock check valve 21, which is connected to the piston side of secondary actuators 30.

If the pressurising of the primary actuators 28, 29 by means of the primary unlock circuit for some reason is insufficient to move the lock element 27 to the unlock position, the secondary unlock circuit will be activated. This is done by supplying pressure to inlet 45 of secondary unlock inlet/outlet valve 40, which closes outlet 46. Hydraulic fluid flows from secondary unlock inlet/outlet valve 40 to secondary unlock shuttle valve 22 and to the control port of pilot operated check valve 2. If not already open, pilot operated check valve 2 is thereby opened, which allows hydraulic fluid to flow from the piston rod side of the hydraulic actuators 28, 29, 30, out through outlet 42 of the lock circuit. Further hydraulic fluid flows from secondary unlock inlet/outlet valve 40, through secondary unlock check valve 21 and further to the piston side of secondary actuators 30, which thereby contributes to moving the lock element in direction 56, to the unlock position.

It is seen that the first primary actuators 28, the second primary actuators 29 and the secondary actuators 30 all have a number of three, i.e. there is a total of nine actuators, which can be alternatively arranged in a circle in the riser connector 19.

The primary and secondary unlock circuits may fail, and in order to still be able to move the lock element 27 to the unlock position, the circuitry comprises a backup unlock circuit for actuating the hydraulic actuators to move the lock element to the unlock position.

The backup unlock circuit comprises a supply branch with a source for pressurised hydraulic fluid, formed by three accumulators 16. The accumulators 16 are connected to a ROV (remotely operated vehicle) enable valve 18, which is connected to backup unlock main valve 9. Backup unlock main valve 9 is connected to a flow divider 8 with three outlets, each being connected to a check valve 7, 23, 24. The check valves 7, 23, 24 are connected to the secondary unlock circuit, the second primary unlock circuit and the first primary unlock circuit, respectively.

The backup unlock circuit also comprises a pilot branch with a source for pressurised hydraulic pilot fluid, formed by two pilot accumulators 14. The pilot accumulators 14 are connected to backup unlock trigger valve 11, having a mechanical trigger 54. Backup unlock trigger valve 11 is connected to ROV enable valve 10, which is connected to a control port of backup unlock main valve 9. ROV enable valve is also connected to the primary unlock shuttle valve 6, a control port of backup vent valve 1 and a control port of pilot operated vent valve 4.

In FIG. 2 the backup unlock circuit is disabled, which it will be during e.g. deploying the BOP stack to the wellhead. The disabling of the backup unlock circuit has been done at surface prior to BOP deployment or subsea prior to BOP retrieval by a ROV which can be connected to the ROV connections 50 or 51 of ROV enable valve 10 and the POV connections 52 or 53 of ROV enable valve 18. To disable the backup unlock circuit, the ROV enable valves 10 and 18 are set to closed position. A ROV can also be connected to ROV reset receptacle 12, to reset the backup unlock trigger valve 11, i.e. set backup unlock trigger valve 11 to closed position and bring the trigger 54 into position for triggering the valve, as shown in FIG. 2.

Figure 3:
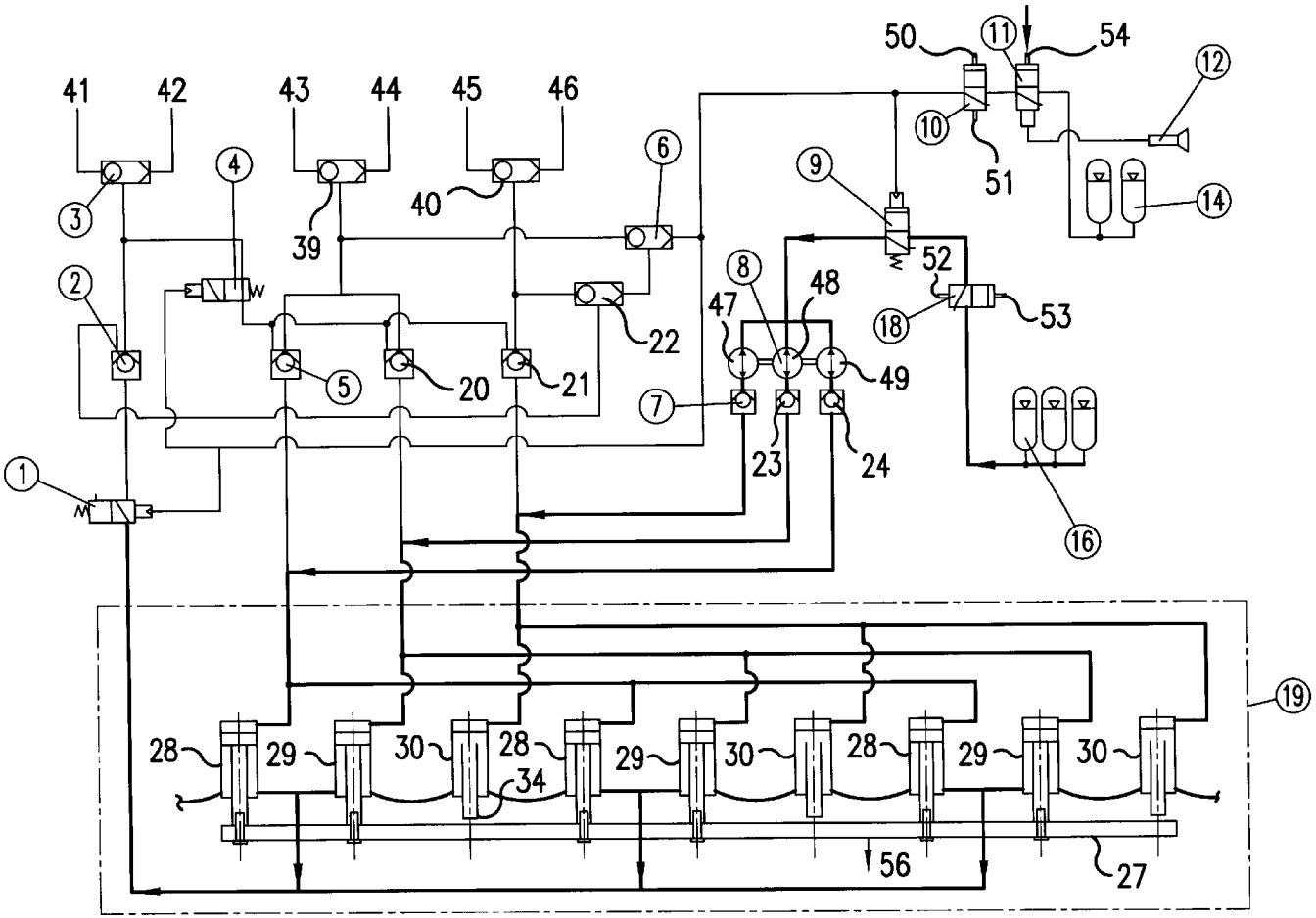
FIG. 3 is a diagram illustrating the system according to the invention with the backup unlock circuit in an enabled state, triggered by a trigger valve.

In FIG. 3 the backup unlock circuit is enabled, which it will be during normal operation, i.e. during drilling. The enabling of the backup unlock circuit has been done by a ROV, which has set the ROV enable valves 10 and 18 to open position. Further, backup unlock trigger valve 11 has been triggered by a not illustrated mechanism which is connected to the riser, and which, when the angle of the riser exceeded a predetermined critical value, pushed the trigger 54 down. Backup unlock trigger valve 11 was thereby opened, and a in FIG. 3 a backup unlock is in progress.

Hydraulic pilot fluid flows from the pilot accumulators 14, through backup unlock trigger valve 11 through ROV enable valve 10 and to the control port of backup unlock main valve 9, which has been opened. Pilot fluid also flows to primary unlock shuttle valve 6, further to secondary unlock shuttle valve 22 and further to the control port of pilot operated check valve 2, which has been opened. Further pilot fluid flows to the control port of backup vent valve 1, which has been moved to a position in which hydraulic fluid from the piston rod side of the hydraulic actuators 28, 29, 30 is vented to the surrounding, sea. Pilot fluid also flows to the control port of pilot operated vent valve 4, which has thereby been closed. Thereby possible pressure in the lock circuit cannot open the unlock check valves 5, 20, 21, i.e. hydraulic fluid from the backup unlock circuit cannot flow to the outlets 44, 46 of the primary and secondary unlock circuits.

The opening of the backup unlock main valve 9 allows hydraulic fluid to flow from the hydraulic accumulators 16, through ROV enable valve 18, through backup unlock main valve 9 and to the flow divider 8. The flow divider 8 is a triple flow divider, which divides the fluid flow into three independent flows one flow for pressurising the first primary actuators 28, one flow for pressurising the second primary actuators 29 and one flow for pressurising the secondary actuators 30. Since the first primary actuators, the second primary actuators and the secondary actuators all have a number of three, each flow from the flow divider 8 is again divided into three flows, each flow being directed into the piston side of a hydraulic actuator. The lock element 27 is thereby moved in direction 56, to the unlock position.

The flow divider 8 illustrated in FIG. 2 and 3 comprises, for each independent flow, a fixed capacity hydraulic pump/motor unit 47, 48, 49 driven by the fluid flow front the source 16. Rotors of the pump/motor units 47, 48, 49 are mechanically interconnected by a transmission or a common shaft, and thereby rotate at the same speed. It is thereby ensured that the independent flows through the hydraulic pump/motor units 47, 48, 49 are equal, Check valves 7, 23 and 24 prevent return flow of hydraulic fluid.

Figure 4:
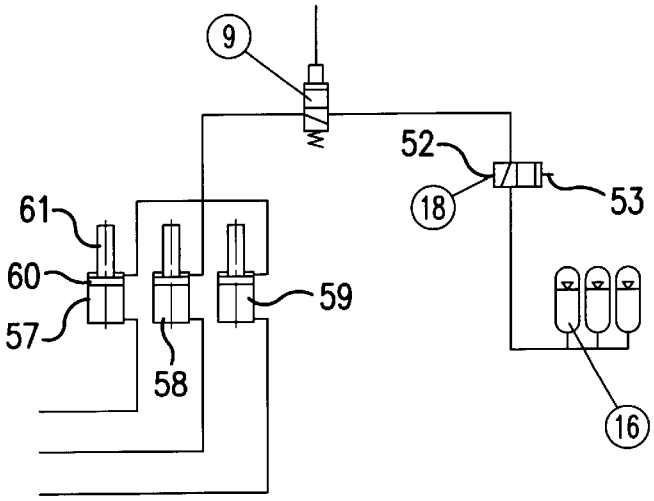
FIG. 4 is a part of a diagram illustrating the system according to the invention, illustrating a flow divider.

FIG. 4 illustrates a part of the backup unlock circuit with a preferred flow divider which is an alternative to the flow divider 8 in FIGS. 2 and 3. The flow divider in FIG. 4 comprises a hydraulic cylinder 57, 58, 59 for each independent flow. For each hydraulic cylinder 57, 58, 59 one side of a piston 60 is connected to a conduit for fluid flow from the source 16 and the other side of the piston 60 is connected to a conduit for the independent flow.

Due to the flow divider, if one conduit for an independent flow from the flow divider breaks or bursts, only pressure in that independent flow will be lost, while the other independent flows will maintain their pressure. Consequently, only the hydraulic actuators which should have been pressurised by the flow in the broken conduit will lose the supply of hydraulic pressure.

What is claimed is:

1. A system for connecting and disconnecting a lower end of a marine riser (25) to and from a blow out preventer stack on a subsea wellhead, comprising:

a riser connector (19) comprising:

gripping members (26) movable between a clamping position in which they clamp the riser end (25) and a release position in which the riser end (25) is released, a lock element (27) movable between a lock position in which the lock element (27) lock the gripping members (26) in the clamping position and an unlock position in which the gripping members (26) are free to move to their release position, primary hydraulic actuators (28, 29) able to move the lock element (27) between the lock position and the unlock position, secondary hydraulic actuators (30) merely able to move the lock element (27) to the unlock position, and hydraulic circuitry comprising:

a hydraulic lock circuit (1, 2, 3, 41, 42) for actuating the primary actuators (28, 29) to move the lock element (27) to the lock position and move the secondary actuators (30) to a position from which they can move the lock element (27) to the unlock position, a hydraulic primary unlock circuit (5, 20, 39, 43, 44) for actuating the primary actuators (28, 29) to move the lock element (27) to the unlock position, a hydraulic secondary unlock circuit (21, 40, 45, 46) for actuating the secondary actuators (30) to move the lock element (27) to the unlock position, characterized in that the primary unlock circuit (5, 20, 39, 43, 44) comprises a first primary unlock circuit (5, 39, 43, 44) for actuating first primary actuators (28) and a second primary unlock circuit (20, 39, 43, 44) for actuating second primary actuators (29), and the system further comprises:

a hydraulic backup unlock circuit (9, 11, 16) for actuating the primary and secondary actuators (28, 29, 30) to move the lock element (27) to the unlock position, the backup unlock circuit comprises a source (16) for pressurised hydraulic fluid and a triple flow divider (8) for dividing fluid flow from the source (16) into one flow for actuating the first primary actuators (28), one flow for actuating the second primary actuators (29) and one flow for actuating the secondary actuators (30).

2. A system according to claim 1, wherein the flow divider (8) comprises, for each independent flow, a fixed capacity hydraulic pump/motor unit (47, 48, 49) driven by the fluid flow from the source (16), the rotors of the pump/motor units (47, 48, 49) rotate at the same speed by a mechanical interconnection.

3. A system according to claim 1 or 2, wherein the flow divider comprises a hydraulic cylinder (57, 58, 59) for each independent flow, for each hydraulic cylinder (57, 58, 59) one side of a piston (60) is connected to a conduit for fluid flow from the source (16) and the other side of the piston (60) is connected to a conduit for the independent flow.

4. A system according to claim 1, wherein the backup unlock circuit comprises a pilot branch (10,11) with a source (14) for pressurized hydraulic pilot fluid, for controlling (9) the supply of hydraulic fluid from the source (16) for pressurized hydraulic fluid.

5. A system according to claim 4, wherein the pilot branch comprises a mechanically operated trigger valve (11) for the flow from the source (14).

6. A system according to claim 1, wherein the lock circuit comprises a backup vent valve (1), a control port of a the backup vent valve (1) is connected to the backup unlock circuit for venting the lock circuit to the surroundings during an activating of the backup unlock circuit.

7. A system according to claim 1, wherein the first primary unlock circuit, the second primary unlock circuit and the secondary unlock circuit comprises pilot operated check valves (5,20,21) for preventing flow of hydraulic fluid from the backup unlock circuit to outlets (44,46) of the first and second primary unlock circuits and the secondary unlock circuit.

8. A system according to claim 7, wherein control ports of the pilot, operated check valves (5, 20, 21) are connected to the lock circuit via a pilot operated vent valve (4), for opening the check valves (5, 20, 21) during an activating of the lock circuit, a control port of the pilot operated vent valve (4) is connected to the backup unlock circuit for closing the pilot operated vent valve (4) during an activating of the backup unlock circuit.

9. A system according to claim 1, wherein the lock circuit comprises a pilot operated check valve (2) for preventing flow of hydraulic fluid from the hydraulic actuators (28,29, 30) to an outlet (42) of the lock circuit, a control port of the pilot operated check valve (2) is connected to the backup unlock circuit for opening the pilot operated check valve (2) during an activating of the backup unlock circuit.

10. A system according to claim 1, wherein the lock circuit comprises a pilot operated check valve (2) for preventing flow of hydraulic fluid from the hydraulic actuators (28,29,30) to an outlet (42) of the lock circuit, a control port of the pilot operated check valve (2) is connected to the primary and secondary unlock circuits for opening the pilot operated check valve (2) during an activating of the primary or secondary unlock circuit.

* * * * *